US005614785A

United States Patent [19]

Wallace et al.

[11] Patent Number: 5,614,785

[45] Date of Patent: Mar. 25, 1997

[54] ANODE PLATE FOR FLAT PANEL DISPLAY HAVING SILICON GETTER

[75] Inventors: Robert M. Wallace, Richardson; Bruce E. Gnade, Dallas; Wiley P. Kirk, Richardson, all of Tex.

[73] Assignee: Texas Instruments Incorporated, Dallas, Tex.

[21] Appl. No.: 535,863

[22] Filed: Sep. 28, 1995

[51] Int. Cl.[6] ..... H01J 1/72; H01J 9/38

[52] U.S. Cl. ..... 315/496; 313/466; 313/559; 445/24; 445/55

[58] Field of Search ..... 313/461, 495, 313/496, 466, 481, 553, 559; 445/24, 55

[56] References Cited

U.S. PATENT DOCUMENTS

| | | | |
|---|---|---|---|
| 4,608,518 | 8/1986 | Fukuda et al. | 313/481 |
| 5,063,323 | 11/1991 | Longo et al. | 313/553 |
| 5,223,766 | 6/1993 | Nakayama et al. | 313/495 |
| 5,453,659 | 9/1995 | Wallace et al. | 313/495 |
| 5,491,376 | 2/1996 | Levine et al. | 313/495 |
| 5,502,348 | 3/1996 | Moyer et al. | 313/553 |
| 5,520,563 | 5/1996 | Wallace et al. | 445/24 |
| 5,525,857 | 6/1996 | Gnade et al. | 313/309 |
| 5,528,102 | 6/1996 | Gnade et al. | 313/496 |

OTHER PUBLICATIONS

P. Gupta et al, "Hydrogen desorption kinetics from monohydride and dihydride species on silicon surfaces," *Physical Review B*, 15 May 1988, vol. 37, No. 14, pp. 8234–8243.

P.S. Taylor et al., "The Dissociative Adsorption of Ammonia on Si(100)," *Surface Science* 215, (1989)—North–Holland, Amsterdam, pp. L286–292.

M.J. Dresser et al., "The Adsorption and Decomposition of NH3, on Si(100)—Detection of the NH2(a) Species," *Surface Science* 218, (1989),—North–Holland, Amsterdam, pp. 75–107.

R.M. Wallace et al., "Ni impurity effects on hydrogen surface chemistry and etching of Si(111)," *Applied Surface Science* 45, (1990)—North–Holland, pp. 201–206.

P.A. Taylor et al., "The Adsorption and thermal decomposition of PH3 on Si(111)–(7×7)," *Surface Science* 238, (1990)—North–Holland, pp. 1–12.

R.M. Wallace et al., "An ESDIAD study of chemisorbed hydrogen on clean and H–exposed Si(111)–(7×7)," *Surface Science* 239, (1990)—North–Holland, pp. 1–12.

N. Hirashita et al., "Effects of surface hydrogen on the air oxidation at room temperature of HF–treated Si(100) surfaces," *Appl. Phys. Lett.* 56(5), 29 Jan. 1990, pp. 451–453.

G. S. Higashi et al., "Ideal hydrogen termination of the Si(111) surface," *Appl. Phys. Lett.* 56(7), 12 Feb. 1990, pp. 656–658.

C.C. Cheng et al., "Direct determination of absolute monolayer converages of chemisorbed $C_3H_3$ and $C_2H_4$ on Si(100)," *J. Appl. Phys.* 67(8), 15 Apr. 1990, pp. 3693–3699.

T. Shibata et al., "Low–Temperature Si Surface Cleaning by Hydrogen Beam with Electron–Cyclotron–Resonance Plasma Excitation," MRS 1989 Fall Meeting Symp. D 2.10. Boston, MA 1989, vol. 160., pp. 1181–1183.

S. S. Iyer et al., "Low–temperature silicon cleaning via hydrogen passivation and conditions for epitaxy," *Appl. Phys. Lett.*, vol. 57, No. 9, 27 Aug. 1990, pp. 893–895.

(List continued on next page.)

*Primary Examiner*—Michael Horabik
*Assistant Examiner*—Michael Day
*Attorney, Agent, or Firm*—Christopher L. Maginniss; James C. Kesterson; Richard L. Donaldson

[57] ABSTRACT

An anode plate (10) for use in a field emission flat panel display device (8) includes a transparent substrate (26) having a plurality of spaced-apart, electrically conductive regions (28) are covered by a luminescent material (24) and from the anode electrode. A getter material (29) of porous silicon is deposited on the substrate (26) between the conductive regions (28) of the anode plate (10). The getter material (29) of porous silicon is preferably electrically nonconductive, opaque, and highly porous. Included are methods of fabricating the getter material (29) on the anode plate (10).

20 Claims, 5 Drawing Sheets

OTHER PUBLICATIONS

L.T. Canham, "Silicon quantum wire array fabrication by electrochemical and chemical dissolution of wafers," *Appl. Phys. Lett.* 57(10), 3 Sep. 1990, pp. 1046–1048.

T. Takahagi et al., "Control of the chemical reactivity of a silicon single–crystal surface using the chemical modification technique," *J. Appl. Phys.*, vol. 68, No. 5, 1 Sep. 1990, pp. 2188–212191.

R.M. Wallace et al., "$PH_3$ surface chemistry on Si(111)–(7×7): A study by Auger spectroscopy and electron stimulated desorption methods," *J. Appl. Phys.* 68(7), 1 Oct. 1990, pp. 3669–3678.

R. S. Becker et al., "Atomic Scale Conversion of Clean Si(111): H–1 × 1 to Si(111)–2×1 by Electron–Stimulated Desorption," *Physical Review Letters*, vol. 65, No. 15, 8 Oct. 1990, pp. 1917–1920.

P. Gupta et al., "FTIR studies of $H_2O$ and $D_2O$ decompsition on porous silicon surfaces," *Surface Science* 245, (1991), North–Holland, pp. 360–372.

T. Yasaka et al, "Chemical Stability of HF–Treated Si(111) Surfaces," *Surface Science* 268, (1992) North–Holland, pp. 205–216.

R.T. Collins et al., "Photoinduced hydrogen loss from porous silicon," *Appl. Phys. Lett.*, vol. 61, No. 14, 5 Oct. 1992, pp. 1649–1651.

J. H. Craig, Jr. et al., "Electron desorption study of HF etched Si(100)," *J. Vac. Sci. Technol.* A 11(3), May/June 1993, pp. 554–556.

M.B. Robinson et al., "Porous silicon photoluminescence versus HF etching: No correlation with surface hydrogen species," *Appl. Phys. Lett.*, vol. 62., No. 13, 29 Mar. 1993, pp. 1493–1495.

R. Kumar et al., "Effect of surface treatment on visible luminescence of porous silicon: Correlation with hydrogen and oxygen terminators," *Appl. Phys. Lett.* 63 (22), vol. 63, No. 22, 29 Nov. 1993, pp. 3032–3034.

P.A. Taylor et al., "Adsorption & Decomposition of Acetylene on Si(100)–(2×1) American Chemical Society", vol. 114, (1992) pp. 6754–6760.

L. Clemen et al., "Adsorptoon & Thermal Behavior on Si(100)–(2×1) Surface Science" 268 (1992) pp. 205–216.

Y. Morita et al., "Atomic Structure of Hydrogen–Terminated Si(111) Surfaces by Hydrofluoric Acid Treatments", Jpn Journal of Applied Physics (vol. 30) No. 12B Dec. 1991, pp. 3570–3574.

ANODE PLATE FOR FLAT PANEL DISPLAY HAVING SILICON GETTER

RELATED APPLICATIONS

This application is related to copending application Ser. No. 08/535,506, entitled Anode Plate for Flat Panel Display Having Integrated Getter, filed Sep. 28, 1995, application Ser. No. 08/292,915, entitled Low Density, High Porosity Material as Gate Dielectric for Field Emission Device, filed Aug. 19, 1994, now U.S. Pat. No. 5,525,857, application Ser. No. 08/253,476, Flat Panel Display Anode Plate Having Isolation Grooves, filed Jun. 3, 1994, now U.S. Pat. No. 5,491,376, application Ser. No. 08/258,803, entitled Anode Plate for Flat Panel Display Having Integrated Getter, filed Jun. 10, 1994, now U.S. Pat. No. 5,453,659, and copending application Ser. No. 08/247,951, entitled Opaque Insulator for Use on Anode Plate of Flat Panel Display, filed May 24, 1994, all applications of the same assignee.

TECHNICAL FIELD OF THE INVENTION

The present invention relates generally to flat panel displays and, more particularly, to a structure and method for providing improved gettering within a field emission flat panel display.

BACKGROUND OF THE INVENTION

The advent of portable computers has created demand for display devices which are lightweight, compact, and power efficient. Since the space available for the display of these devices precludes the use of a conventional cathode ray tube (CRT), there has been an effort to produce flat panel displays having comparable or even superior display characteristics.

Liquid crystal displays are commonly used for laptop and notebook computers. These displays may suffer from poor contrast, a limited range of viewing angles, and power requirements which are incompatible with extended battery operation. In addition, color liquid crystal displays tend to be far more costly than CRTs of equal screen size.

As a result of these limitations of liquid crystal display technology, field emission display technology has received more attention in the industry. Field emission flat panel displays employ a matrix-addressable array of field emission cathodes in combination with an anode comprising a luminescent screen. The manufacture of inexpensive, low-power, high-resolution, high-contrast, full-color flat panel displays using this technology appears promising.

In order for field emission displays to operate efficiently, it is desirable to maintain a vacuum within the cavity of the display, typically less than $10^{-6}$ Torr. The cavity is pumped out and degassed before assembly, but over time the pressure in the display builds up due to outgassing of the components inside the display and to the finite leak rate of the atmosphere into the cavity. Getters are employed as pumps that adsorb these undesirable gases in order to maintain a minimum pressure in the cavity.

In field emission flat panel displays, the cathode or emitter plate and the anode plate may be spaced from one another at a relatively small distance. This spacing, typically on the order of two hundred microns, limits the total volume of the cavity enclosed within the display screen. Due to the limited volume within the cavity, the getter is normally placed in peripheral regions, such as in the pump-out tubulation at the back of the display. The placement of the getter material outside of the active region of the display in combination with the small volume within the cavity severely reduces the pumping effectiveness of the getter.

SUMMARY OF THE INVENTION

In accordance with the present invention, the disadvantages and problems associated with the use of a getter to maintain a vacuum within a field emission flat panel display have been substantially reduced or eliminated.

In accordance with one embodiment of the present invention, an anode plate for use in a display device comprises a substantially transparent substrate. A plurality of spaced-apart, electrically conductive regions are located on the substrate. A luminescent material is adjacent to the conductive regions. Getter material is disposed on the substrate and between the conductive regions.

In accordance with another aspect of the present invention, a method for fabricating an anode plate for use in a display device comprises the steps of providing a substantially transparent substrate, forming a plurality of spaced-apart, electrically conductive regions on the substrate, forming a getter material on the substrate and between the conductive regions, and forming a luminescent material on the conductive regions.

Important technical advantages of the present invention include maintaining the vacuum integrity of a field emission flat panel display over the life of the display. This is accomplished by placing the getter material in close proximity to the display elements which are subject to outgassing and to those elements of the display which are adversely effected by increases in gas pressure. In particular, a getter material is deposited on the substrate and between the conductive regions of the anode plate. This placement substantially increases the pumping effectiveness of the getter material over other systems that place getters in the periphery of the display.

Other important technical advantages of the present invention include providing an electrically nonconductive getter which can be deposited within the cavity of the display. In the preferred embodiment, this getter material comprises porous silicon. Porous silicon provides a voltage standoff between conductive regions on the anode plate. Furthermore, porous silicon may be deposited as an opaque material between phosphor stripes to improve display performance by improving the contrast ratio.

BRIEF DESCRIPTION OF THE DRAWINGS

For a more complete understanding of the present invention, and for further features and advantages, reference is now made to the following description taken in conjunction with the accompanying drawings, in which.

DETAILED DESCRIPTION OF THE INVENTION

Figure 1:
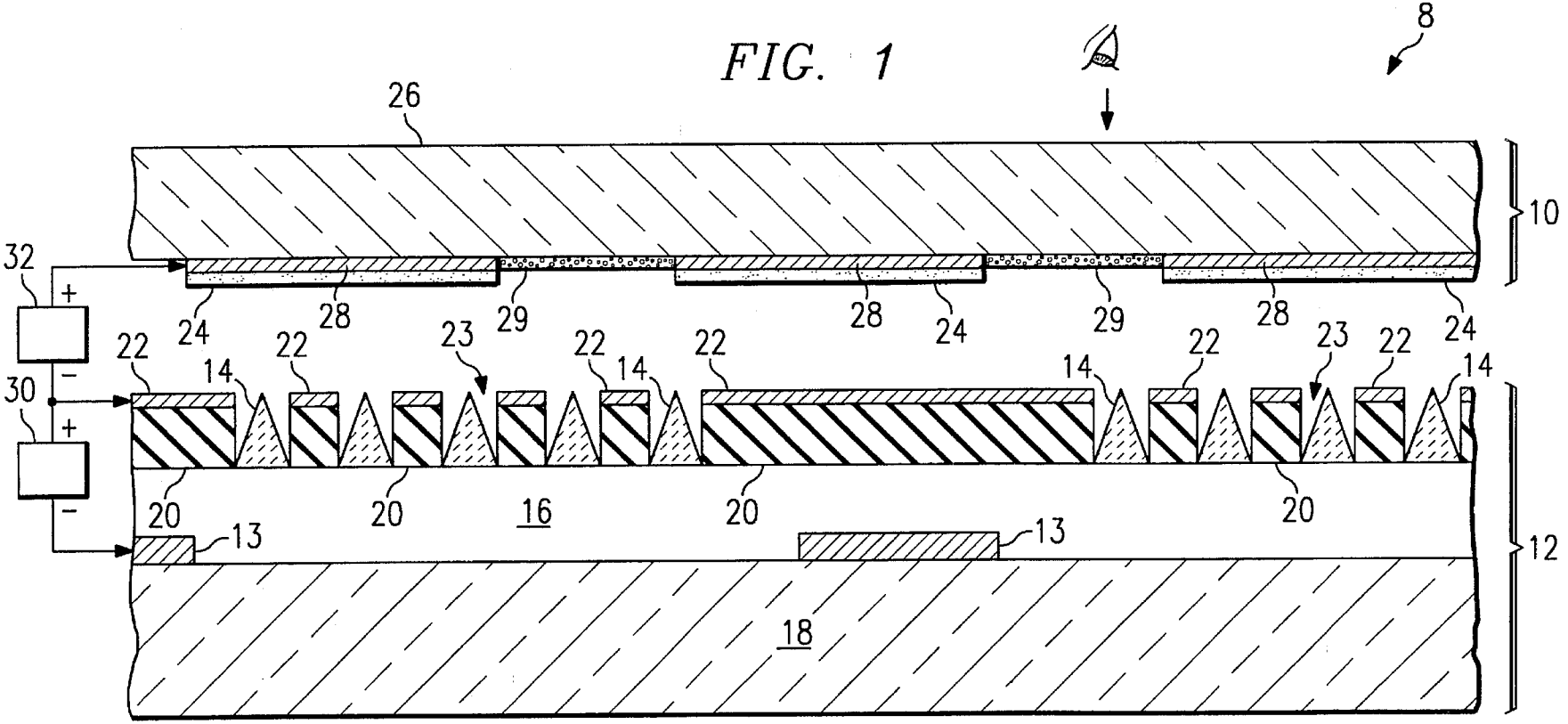
FIG. 1 illustrates in cross section a portion of a field emission flat panel display device.

FIG. 1 illustrates, in cross-section, a display device 8 which comprises an anode plate 10 and an emitter (or cathode) plate 12. The cathode portion of emitter plate 12 includes conductors 13 formed on an insulating substrate 18, a resistive layer 16 also formed on substrate 18 and overlaying conductors 13, and a plurality of electrically conductive emitters 14 formed on resistive layer 16. When viewed from above, conductors 13 comprise a mesh structure, and emitters 14 are configured as a matrix within the mesh spacings.

In one embodiment, display device 8 may be a field emission display device that benefits from removal of all ambient species between anode plate 10 and emitter plate 12. Display device 8 may also be a plasma display, in which the space between anode plate 10 and emitter plate 12 contains a plasma. A getter material for a plasma display may be chosen to react with undesirable species without substantially degrading the plasma.

Gate electrode 22 comprises a layer of an electrically conductive material deposited on an insulating layer 20 which overlays resistive layer 16. Emitters 14 are in the shape of cones which are formed within apertures 23 through gate electrode 22 and insulating layer 20. The thickness of the conductive layer forming gate electrode 22 and the thickness of insulating layer 20 are chosen in conjunction with the size of apertures 23 so that the apex of each emitter 14 is substantially level with gate electrode 22. Gate electrode 22 is arranged as rows of conductive bands across the surface of substrate 18, and the mesh structure of conductors 13 is arranged as columns of conductive bands across the surface of substrate 18. Emitters 14 are activated by energizing a row of gate electrode 22 and a column of conductors 13, which correspond to a pixel of display device 8.

Figure 2A:
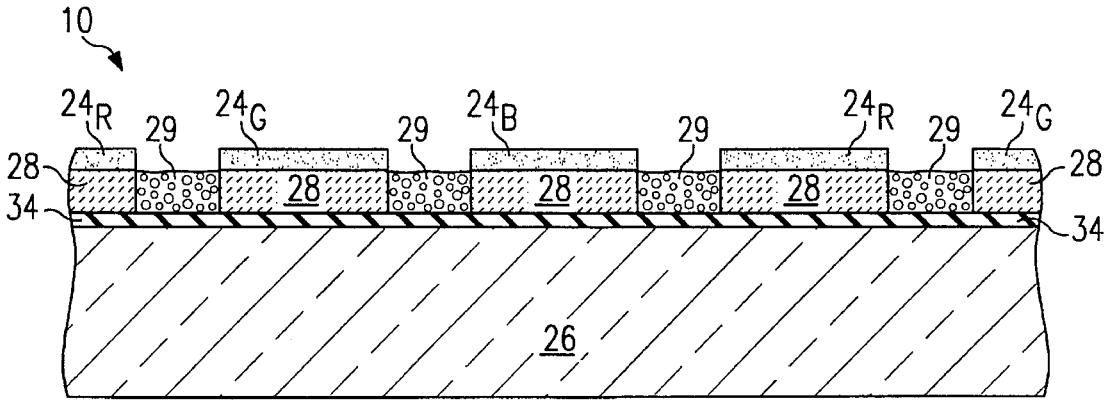
FIG. 2A illustrates in cross section a portion of an anode plate of a field emission flat panel display device corresponding to a first embodiment of the present invention.
Figure 2B:
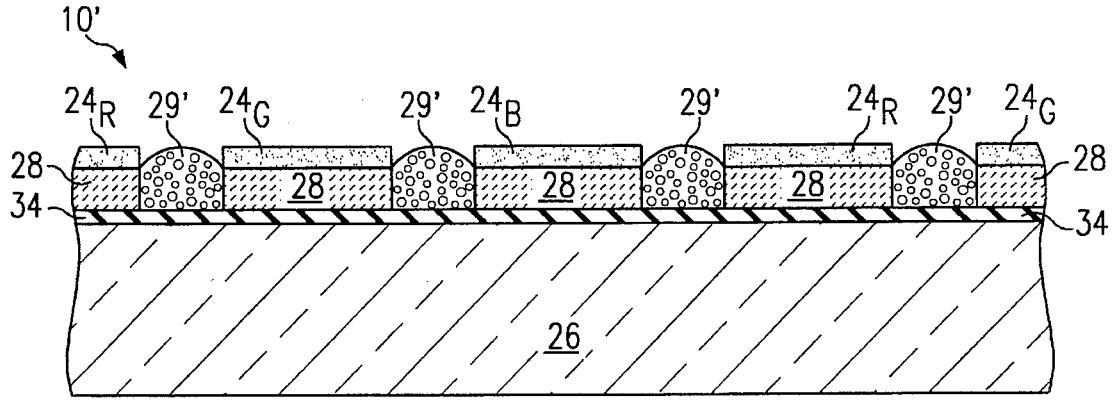
FIG. 2B illustrates in cross section a portion of an anode plate of a field emission flat panel display device corresponding to a second embodiment of the present invention.

Anode plate 10 comprises a substantially transparent substrate 26 with a plurality of electrically conductive regions 28 formed on substrate 26. In one embodiment, conductive regions 28 are spaced-apart to form parallel stripes on anode plate 10. Conductive regions 28 may also be continuous, such as the structure found in a cathode ray tube (CRT). Conductive regions 28 are formed on the surface of substrate 26, or on an optional thin insulating layer of silicon dioxide ($SiO_2$) 34 (FIGS. 2A and 2B). In display device 8, conductive regions 28 of anode plate 10 are positioned opposite gate electrode 22 of emitter plate 12.

In this example, conductive regions 28, which comprise the anode electrode, are in the form of electrically isolated stripes forming parallel conductive bands across the surface of substrate 26. Luminescent material 24 is formed over conductive regions 28 so as to be directly facing and immediately adjacent gate electrode 22. No true scaling information is intended to be conveyed by the relative sizes and positioning of the elements of anode plate 10 and the elements of emitter plate 12 as depicted in FIG. 1.

Getter material 29 is disposed on substrate 26 and between conductive regions 28. Getter material 29, when activated and sealed in display device 8, acts as a pump to adsorb undesirable elements caused by outgassing of surfaces and films inside display device 8 and finite leak rates from the outside atmosphere.

The placement of getter material 29 on anode plate 10 provides several advantages. Getter material 29 is placed in close proximity to those components of display device 8 which are subject to outgassing, such as luminescent material 24 and gate electrode 22, and in close proximity to those components of display device 8 which are adversely affected by increases in gas pressure, such as emitters 14. This placement substantially increases the pumping effectiveness of the getter material from approximately one milliliter per second when getters are placed in the periphery of the display to as much as 1,000 liters per second. By virtue of its electrical insulating quality, getter material 29 increases the electrical isolation between conductive regions 28, which permits higher anode potentials without the risk of breakdown due to increased leakage current. Moreover, getter material 29 may be opaque to improve picture contrast of display device 8.

Emitters 14 are activated by applying a negative potential to conductors 13, functioning as the cathode electrode relative to the gate electrode 22, via voltage supply 30. The induced electric field draws electrons from the apexes of emitters 14. The emitted electrons are accelerated towards anode plate 10, which is positively biased by the application of a larger positive voltage from voltage supply 32 coupled between gate electrode 22 and conductive regions 28 functioning as the anode electrode. Energy from the electrons attracted to conductive regions 28 is transferred to luminescent material 24, resulting in luminescence. The luminescence is observed through conductive regions 28 and substrate 26. The electron charge is transferred from luminescent material 24 to conductive regions 28, completing the electrical circuit to voltage supply 32.

FIG. 2A illustrates, in cross-section, an anode plate 10 for use in display device 8 fabricated using the process steps described below with reference to FIGS. 3A through 3G. Anode plate 10 comprises a transparent substrate 26, which may include a thin layer 34 of an insulating material, such as silicon dioxide ($SiO_2$). A plurality of spaced-apart, electrically conductive regions 28 are patterned on insulating layer 34. Conductive regions 28 collectively comprise the anode electrode of display device 8. Luminescent material $24_R$, $24_G$, and $24_B$, referred to collectively as luminescent material 24, is positioned adjacent to conductive regions 28. Getter material 29 is disposed on substrate 26 and between conductive regions 28.

In the present example, substrate 26 preferably comprises glass. For the case where ultraviolet emission is important, substrate 26 may comprise quartz. Also in this example, conductive regions 28 comprise a plurality of parallel stripe conductors which extend normal to the plane of the drawing sheet. A suitable material for conductive regions 28 may be indium tin oxide (ITO), which is sufficiently optically transparent and electrically conductive. By way of illustration, parallel stripes of conductive regions 28 may be eighty microns in width, and spaced from one another by thirty microns. In this example, luminescent material 24 comprises a particulate phosphor coating which luminesces in one of the three primary colors, red ($24_R$), green ($24_G$), and blue ($24_B$). Luminescent material 24 may also comprise a thin-film phosphorescent material or any other suitable material that luminesces when subjected to electron bombardment or impingement. The thickness of conductive regions 28 may be approximately one hundred and fifty nanometers, and the thickness of luminescent material 24 may be approximately fifteen microns. Luminescent material 24 may be applied to conductive regions 28 using electrophoretic deposition.

A getter, such as getter material 29, has surfaces that can be rendered chemically active so as to promote the adsorption of ambient species. To be highly effective, the getter should have a high surface area to volume ratio. Also the getter should be chosen to specifically react with substances which degrade performance of display device 8, such as water vapor, organic molecules, and various gases. The getter can be rendered active by annealing in a relatively inert ambient, such as a high vacuum or an inert gas environment, and maintained in the ambient during the sealing of display device 8. Getters may also be rendered active by electron stimulated desorption, ECR plasma treatment, or any other process to activate getter surfaces. Examples of conventional metallic getters include evaporable (Ti or Ba) and non-evaporable (Zr-V-Fe, Zr-Al, Zr-Fe, Zr-Ni) types available from SAES Getters of Milan, Italy. Alternatively, non-metallic getters, such as zeolites, are also available.

The present invention utilizes a new type of non-metallic getter based on porous, high surface area, silicon. The silicon is prepared by depositing a precursor of amorphous or polycrystalline silicon on anode plate 10. In one embodiment, porous silicon is formed by galvanostatically etching silicon in a solution of hydrofluoric acid (HF) and ethanol. This etching procedure leaves a highly porous silicon species with a hydrogen terminated surface. The porous silicon may have two hundred square meters or more of surface area for each cubic centimeter of material.

The hydrogen terminated surface is stable over time at room temperature, but the hydrogen can be removed using several techniques. For example, the hydrogen can be removed and the surface activated by heating anode plate 10 to temperatures well below 500° C. Low annealing temperatures make porous silicon compatible with substrate 26 formed from sodalime glass with a softening point of 490° C. The hydrogen may also be removed by electron stimulated desorption, ECR plasma treatment at approximately 400° C., ultraviolet (UV) irradiation, or any other appropriate technique. Once the hydrogen is removed, the silicon surface is very reactive with many different species.

An active metal species, such as the conventional metallic getters described above, may be incorporated into the porous silicon to offer enhanced chemical activity and improved pumping action of the getter. If not already opaque, carbon doping may be used to render the porous silicon opaque to improve picture contrast of display device 8.

Referring now to FIG. 2B, there is shown a cross-sectional view of anode plate 10' for use in display device 8 fabricated using the process steps described below with reference to FIGS. 4A through 4F. In the remaining discussion, elements which are identical to those already described are given identical numerical designators, and those elements which are similar in structure and which perform identical functions to those already described are given the primed numerical designators of their counterparts. In this embodiment, getter material 29' is deposited using a negative photoresist and liftoff process, which results in getter material 29' extending above the plane formed by conductive regions 28.

The surface area available for getter material 29 and 29' deposited on anode plate 10 and 10', respectively, is significantly greater than other previous getter structures. In the embodiment of FIG. 2A, where the interstitial width between conductive regions 28 is thirty microns, the nominal area for depositing getter material 29 for a color display having 640 lines, each of three colors and approximately six inches in length, is almost fourteen square inches compared with about two square inches of getter surface in a typical display device. In the embodiment of FIG. 2B, the area for depositing getter material 29' may be even greater.

Figure 3A:
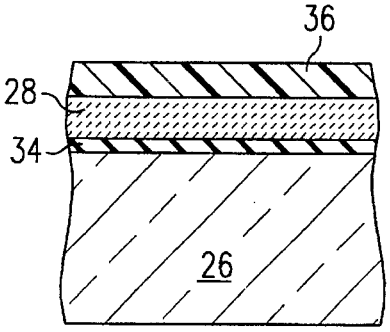
FIGS. 3A through 3G illustrate steps for fabricating the anode plate of FIG. 2A.

FIGS. 3A through 3G illustrate process steps for fabricating anode plate 10 of FIG. 2A. Referring to FIG. 3A, a glass substrate 26 is coated with an insulating layer 34, typically $SiO_2$, which may be sputter deposited to a thickness of approximately fifty nanometers. A transparent, electrically conductive layer 28, typically indium tin oxide (ITO), is deposited on insulating layer 34, for example by sputtering to a thickness of approximately one hundred and fifty nanometers. A photoresist layer 36, such as type AZ-1350J sold by Hoecht-Celanese of Sommerville, N.J., is coated over conductive layer 28 to a thickness of approximately one thousand nanometers.

Figure 3B:
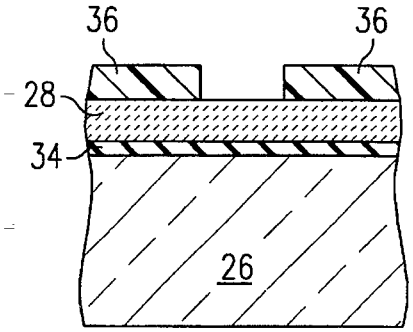
Figure 3C:
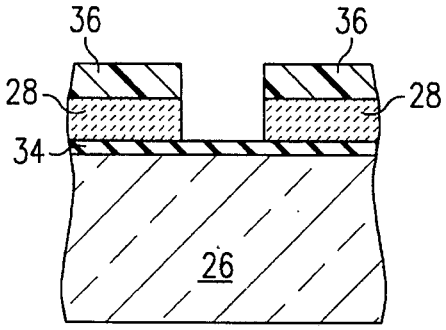

A patterned mask is disposed over photoresist layer 36 exposing regions of the photoresist. In the case of this illustrative positive photoresist, the exposed regions are removed during the development step, which may comprise soaking the assembly in Hoecht-Celanese AZ-developer. The developer removes unwanted photoresist, leaving photoresist layer 36 patterned as shown in FIG. 3B. The exposed regions of conductive layer 28 are then removed, typically by a wet etch process, using for example an etchant solution of 6M hydrochloric acid (HCl) and 0.3M ferric chloride ($FeCl_3$), leaving a structure as shown in FIG. 3C. Although not shown as a part of this process, it may also be desirable to remove insulating layer 34 underlying the etched-away regions of the conductive layer 28.

Figure 3D:
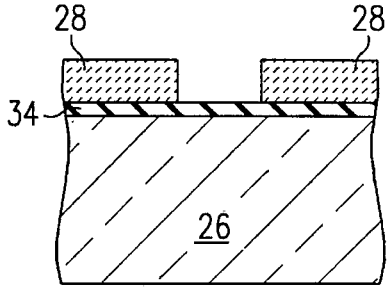

The patterning, developing, and etching processes leave regions of conductive layer 28 which form substantially parallel stripes across the surface of anode plate 10. The remaining photoresist layer 36 may be removed by a wet etch process using an appropriate etchant, such as acetone. Alternatively, photoresist layer 36 may be removed using a dry, oxygen plasma ash process. FIG. 3D illustrates the anode structure having patterned conductive layer 28 at the current stage of the fabrication process.

Figure 3E:
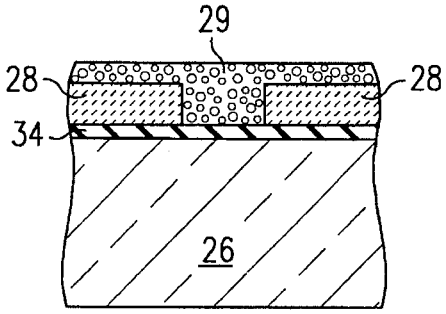

A precursor to the porous silicon getter comprises an amorphous (or polycrystalline) silicon precursor layer 29 deposited over patterned conductive layer 28 and insulating layer 34, as shown in FIG. 3E. In one embodiment, precursor layer 29 is deposited to an average thickness of approximately one thousand nanometers above the surface of insulating layer 34. The method of deposition may comprise deposition of amorphous silicon by chemical vapor deposition at approximately 300° C. Alternatively, a sputtered silicon layer may be deposited at or near room temperature.

Precursor layer 29 is subjected to a galvanostatic etch process comprising hydrofluoric acid (HF) and ethanol, which results in a highly porous silicon layer 29 with a large surface area terminated with hydrogen. Rendering precursor layer 29 porous at this stage of fabrication also avoids damaging conductive layer 28.

Figure 3F:
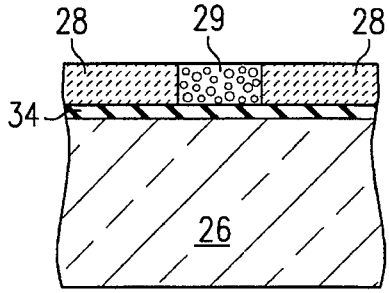
Figure 3G:
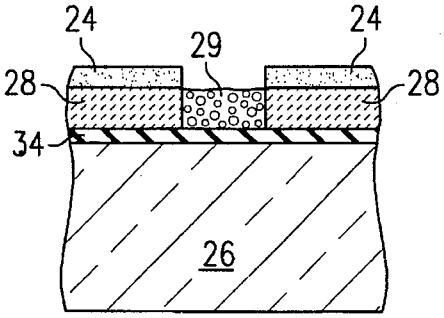

Porous silicon layer 29 is then etched, for example by a plasma etch process, until conductive layer 28 is exposed, as shown in FIG. 3F. Particulate phosphor coating 24 is deposited on conductive layer 28, typically by electrophoretic deposition, which results in the structure shown in FIG. 3G.

Figure 4A:
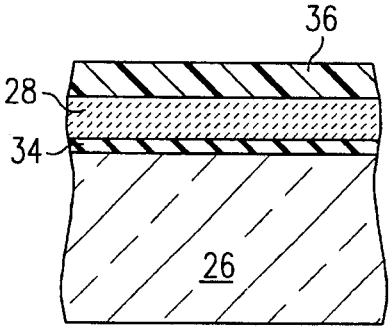
FIGS. 4A through 4H illustrate alternative steps for fabricating the anode plate of FIG. 2A.
Figure 4B:
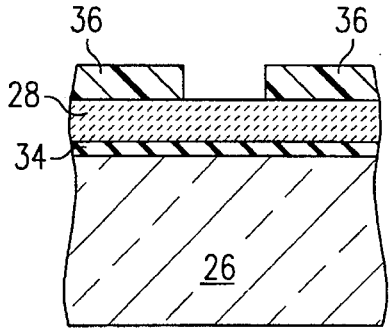
Figure 4C:
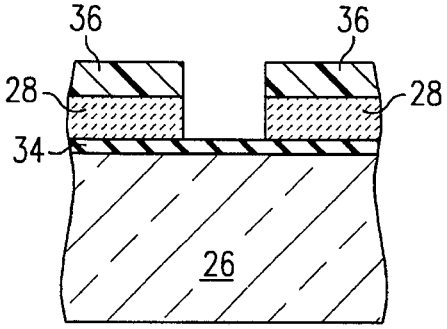
Figure 4D:
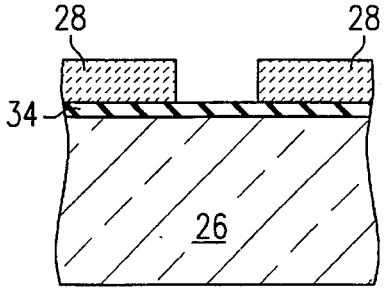
Figure 4E:
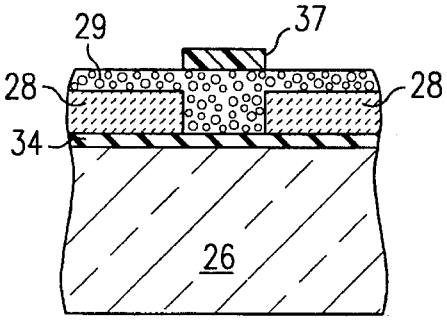
Figure 4F:
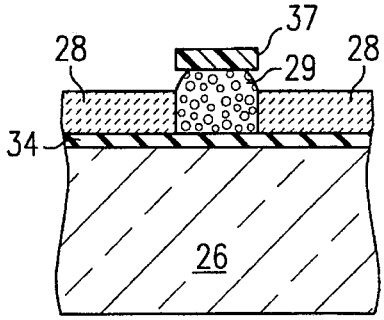
Figure 4G:
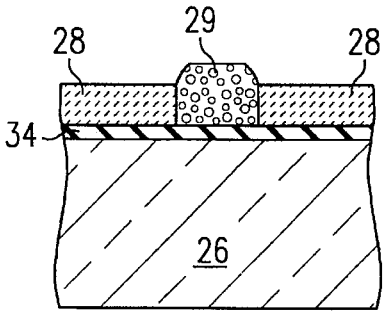
Figure 4H:
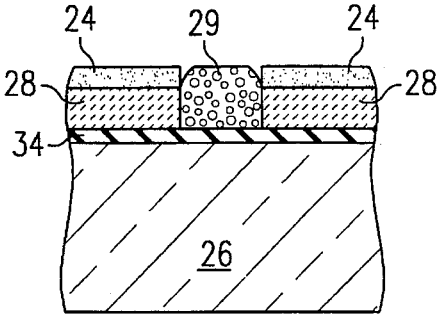

It is possible that the plasma etch process may result in over-etching of portions of porous silicon layer 29 between regions of conductive layer 28. FIGS. 4A through 4H illustrate an alternative process which utilizes a photoresist layer 37 to mask porous silicon layer 29 between regions of conductive layer 28 during the etch process. FIG. 4E illustrates anode plate 10 after forming porous silicon layer 29 and patterning photoresist layer 37, which overlies porous silicon layer 29 between regions of conductive layer 28. After the etch process, portions of porous silicon layer 29 under photoresist layer 37 remain, as shown in FIG. 4F. Photoresist layer 37 is removed (FIG. 4G) and phosphor coating 24 is deposited, which results in the structure shown in FIG. 4H. Photoresist layer 37 may be removed before or after depositing phosphor coating 24.

Porous silicon layer 29 is activated by annealing anode plate 10 to approximately 450° C. in an inert environment, such as a high vacuum or an inert gas, in order to desorb contaminants, such as hydrogen, from the porous silicon getter surfaces. This process activates porous silicon layer 29 and outgasses phosphor coating 24. Alternatively, porous silicon layer 29 can be activated by electron stimulated desorption, ECR plasma treatment, ultraviolet (UV) irradiation, or other techniques.

FIGS. 5A through 5F illustrate process steps for fabricating anode plate 10' of FIG. 2B. Now referring to FIG. 5A, a glass substrate 26 is coated with an insulating layer 34, typically $SiO_2$, which may be sputter deposited to a thickness of approximately fifty nanometers. A transparent, electrically conductive layer 28, typically indium tin oxide (ITO), is deposited on insulating layer 34, for example by sputtering to a thickness of approximately one hundred and fifty nanometers. A photoresist layer 36' such as SC-100 negative photoresist sold by OGC Microelectronic Materials, Inc. of West Patterson, N.J., is coated over conductive layer 28, to a thickness of approximately one thousand nanometers.

Figure 5A:
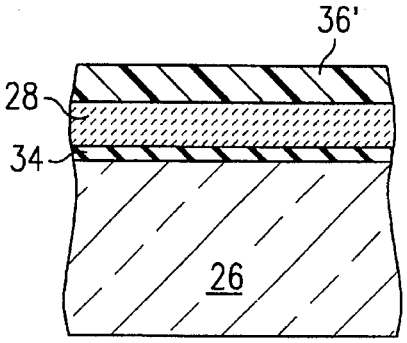
FIGS. 5A through 5F illustrate steps for fabricating the anode plate of FIG. 2B.
Figure 5B:
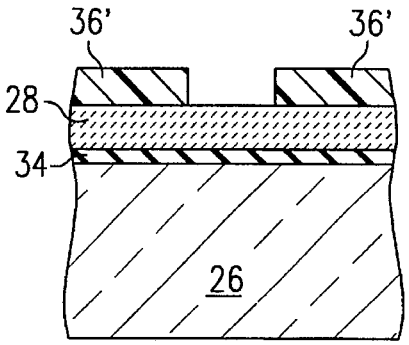
Figure 5C:
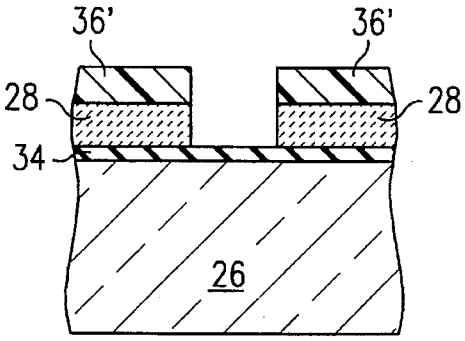

A pattern mask is disposed over photoresist layer 36' exposing regions of the photoresist. In the case of this illustrative negative photoresist, the exposed regions are to remain after the development step, which may comprise spraying the assembly first with Stoddard etch and then with butyl acetate. The unexposed regions of photoresist are removed during the developing process, leaving photoresist layer 36' patterned as shown in FIG. 5B. The exposed regions of conductive layer 28 are then removed, typically by a wet etch process, using for example an etchant solution of 6M hydrochloric acid (HCl) and 0.3M ferric chloride ($FeCl_3$), leaving a structure as shown in FIG. 5C. It may also be desirable to remove insulating layer 34 underlying the etched-away regions of conductive layer 28.

Figure 5D:
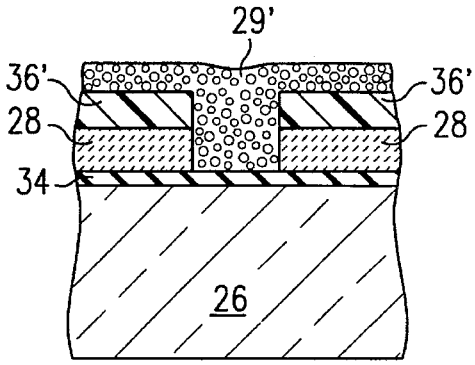
Figure 5E:
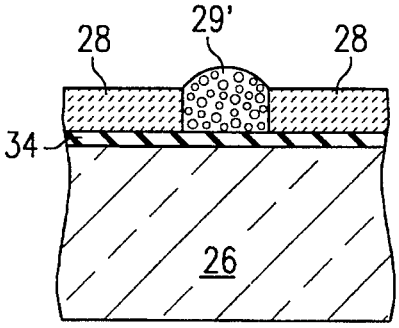

The patterning, developing, and etching processes leave regions of conductive layer 28 which form substantially parallel stripes across the surface of anode plate 10'. In this second embodiment, the remaining photoresist layer 36' is retained and the porous silicon precursor layer 29' is applied over photoresist layer 36' and the exposed regions of insulating layer 34, as shown in FIG. 5D. In this embodiment, the porous silicon precursor layer 29' may be an amorphous silicon layer formed using a low temperature, sputter deposition process. The low temperature process may be desirable due to the presence of photoresist layer 36'.

Layer 29' is rendered porous to form the porous silicon layer 29' as described above with reference to fabrication of anode plate 10. Photoresist layer 36' is removed, bringing with it the overlaying portions of porous silicon layer 29'. This liftoff process is a common semiconductor fabrication process. Hot xylene and a solvent comprising perchloroethylene, orthodichlorobenzene, phenol and alkylaryl sulfonic acid, may be sprayed on the assembly in sequence, to remove photoresist layer 36' resulting in the structure shown in FIG. 5E.

Figure 5F:
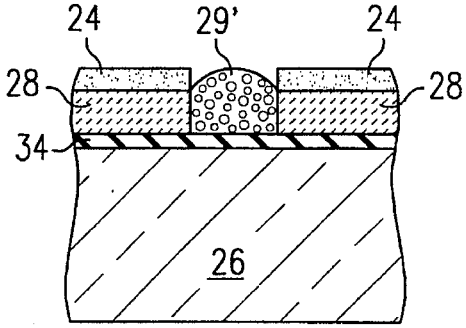

Phosphor coating 24 is deposited on conductive layer 28, typically by electrophoretic deposition, which results in the structure shown in FIG. 5F. Porous silicon layer 29' is activated as described above with reference to anode plate 10. It should be appreciated that the process described in FIGS. 5A through 5F may entail fewer mask steps than that of FIGS. 3A through 3G.

The present invention has been described with reference to a porous silicon getter for an anode plate of a display device. However, the present invention can be used for any component of a variety of display devices, such as plasma displays, cathode ray tubes, liquid crystal displays, and others. Furthermore, the description of the present invention supports use of porous silicon as a getter in general.

Although the present invention has been described with several embodiments, a myriad of changes, variations, alterations, transformations, and modifications may be suggested to one skilled in the art, and it is intended that the present invention encompass such changes, variations, alterations, transformations, and modifications as fall within the scope of the appended claims.

What is claimed is:

1. An anode plate for use in a display device, comprising:

a substantially transparent substrate;

a plurality of spaced-apart, electrically conductive regions on the substrate;

a luminescent material adjacent to the conductive regions; and getter material disposed on the substrate and between the conductive regions, wherein the getter material is porous silicon.

2. The anode plate of claim 1, wherein the substrate comprises an insulating layer adjacent to a glass substrate.

3. The anode plate of claim 1, wherein the spaced-apart, electrically conductive regions comprise substantially parallel stripes.

4. The anode plate of claim 1, wherein the spaced-apart, electrically conductive regions are formed of indium tin oxide.

5. The anode plate of claim 1, wherein the luminescent material comprises a particulate phosphorescent material.

6. The anode plate of claim 1, wherein an active metal species is incorporated in the getter material.

7. The anode plate of claim 1, wherein the getter material is substantially opaque.

8. A field emission device, comprising:

an emitter plate operable to emit electrons; and an anode plate having a substantially planar face opposing the emitter plate, the anode plate comprising:

a substantially transparent substrate;

a plurality of spaced-apart, electrically conductive regions on the substrate;

a luminescent material adjacent to the conductive regions; and getter material disposed on the substrate and between the conductive regions, wherein the getter material is porous silicon.

9. The device of claim 8, wherein the substrate comprises an insulating layer adjacent to a glass substrate.

10. The device of claim 8, wherein the spaced-apart, electrically conductive regions comprise substantially parallel stripes.

11. The device of claim 8, wherein the spaced-apart, electrically conductive regions are formed of indium tin oxide.

12. The device of claim 8, wherein the luminescent material comprises a particulate phosphorescent material.

13. The device of claim 8, wherein an active metal species is incorporated in the getter material.

14. The device of claim 8, wherein the getter material is substantially opaque.

15. A method for fabricating an anode plate for use in a display device, comprising:

providing a substantially transparent substrate;

forming a plurality of spaced-apart, electrically conductive regions on the substrate;

forming a getter material on the substrate and between the conductive regions, wherein the getter material is porous silicon; and forming a luminescent material on the conductive regions.

16. The method of claim 15, wherein the step of providing a substantially transparent substrate comprises the steps of:

providing a glass substrate; and coating the glass substrate with an insulating layer.

17. The method of claim 15, wherein the conductive regions comprise substantially parallel stripes.

18. The method of claim 15, wherein the step of forming a getter material comprises:

depositing a getter precursor; and etching the getter precursor to form the getter material.

19. The method of claim 15, comprising the step of heating the anode plate in an inert environment to desorb contaminants from the getter material.

20. The method of claim 15, wherein the getter material is substantially opaque.

* * * * *